US006457995B1

(12) United States Patent
Brooks

(10) Patent No.: US 6,457,995 B1
(45) Date of Patent: Oct. 1, 2002

(54) VEHICLE FUSE BLOCK EXTENDERS

(76) Inventor: Dennis L. Brooks, 1313 Laredo St., Aurora, CO (US) 80011

( * ) Notice: Subject to any disclaimer, the term of this patent is extended or adjusted under 35 U.S.C. 154(b) by 0 days.

(21) Appl. No.: 09/798,022

(22) Filed: Mar. 2, 2001

(51) Int. Cl.[7] ..... H01R 13/68
(52) U.S. Cl. ..... 439/621; 337/255
(58) Field of Search ..... 439/621, 622, 439/135; 337/197, 190, 255, 256, 264

(56) References Cited

U.S. PATENT DOCUMENTS

| | | | | |
|---|---|---|---|---|
| 3,744,003 A | | 7/1973 | Dipace | |
| 4,372,638 A | | 2/1983 | Sohler | |
| 4,831,353 A | * | 5/1989 | Gaia et al. | 337/255 |
| 4,846,733 A | * | 7/1989 | Baisz et al. | 439/622 |
| 4,884,050 A | | 11/1989 | Kozel | |
| 4,944,697 A | | 7/1990 | Dorman | |
| 5,125,855 A | | 6/1992 | Brooks | |
| 5,139,443 A | * | 8/1992 | Armando | 337/260 |
| 5,346,411 A | | 9/1994 | Nikkinen | |
| 5,507,669 A | * | 4/1996 | Jannett et al. | 337/256 |

* cited by examiner

*Primary Examiner*—Gary R Paumen
*Assistant Examiner*—James R. Harvey
(74) *Attorney, Agent, or Firm*—Joseph C. Herring

(57) ABSTRACT

The fuse block extenders are made up of a shell (10), (10*a*), (10*b*), (10*c*), (10*d*), (10*e*) enclosing a bus electrode (11), circuit electrode (12), (12*a*), electrode base(s) (13), (13*a*), (13*b*) and accessory electrode(s) (17), (17*a*), (17*b*), (17*c*). Some models have a detachable cover (21) and attached cover (21*a*), (21*b*), (21*c*), (21*d*) for the accessory electrodes. The bus electrode and circuit electrodes mate with complementary fuse block electrodes of appropriate capacities and shape and the accessory electrodes connect to the electrodes of accessory circuits.

16 Claims, 6 Drawing Sheets

VEHICLE FUSE BLOCK EXTENDERS

BACKGROUND OF THE INVENTION

A variety of fuses have been designed for use with vehicles. The two most popular commercial fuses are the cartridge fuse, which is being displaced because of size considerations, and the plug fuse.

A variety of fuse block extenders are known and can be bought in auto parts stores in the United States of America. Thus the BWD Automotive Corporation of Franklin Park, Ill. has marketed a twelve piece "D" package of terminal adapters under the "ONE STOP" brand. The package is made up of four types of adapters. The first is a metal strip having a central female contact, a male contact on one end and an insulated crimp for a wire lead on the other. A second has a central female contact with male "spade" or "blade" terminals on each end. A third has a female contact on one end and two side by side male blade contacts on the other. The fourth has a "Z" configuration with a female contact on one end and, on the other end, two parallel male blade contacts offset at right angles on a base which is perpendicular to the female contact.

The adapters have many uses. One of the primary uses is to assist in the connection of automotive accessories to vehicle fuse blocks by connecting leads. The connectors often have a terminal or a contact on one end, a wire lead to a fuse holder, and a wire extending from the fuse holder for connection to the accessory. A male element of the terminal adapter is forced into a vehicle fuse box female contact in parallel with the blade of a plug fuse and can slip or be pulled out and forgotten when the fuse is removed for inspection, etc.

U.S. Pat. No. 4,372,638 issued to L. J. Sohler teaches a form of a terminal adapter to be used with fuse boxes. The connector is bent upon itself at the mid-point to form a blade for insertion into a female contact. At the end of the blade,, the two sides bifurcate at roughly a forty five degree angle. At the point where the width between the two sides becomes greater than that of a plug fuse, the two sides are rebent forty-five degrees to form a parallel male contact which has an outward crimp at it's lower end. The "Y" portion of the connector is inserted into a vehicle fuse block over the top and sides of a blade fuse and fit outside the female contact within the fuse box receptacle. Half of the metal in the rebent portion of the connector is cut away vertically so that the non cut away will rest on top of the fuse box and prevent excessive penetration by the end of the bifurcated section into the receptacle in which the female contact is positioned.

Dennis Brooks has invented "T", "Y", and "L" shaped fuse block extenders. The "L" shaped extender is marketed nationally and internationally. Each of these extenders has one pair of male electrodes 21 which are plugged into female fuse receptacles of a vehicular fuse block. The extenders have two or more pairs of female receptacles into which fuses can be inserted. One, effectively, replaces the fuse block female receptacle into which the receptacle is plugged and the other acts as a receptacle for a second fuse in a vehicular accessory circuit when an accessory electrode is plugged into it.

Automobile design considerations have resulted in the need for smaller fuse blocks. At the same time, the public demand for accessories has increased spectacularly. Since installed fuse blocks cannot be enlarged or the space for the fuse blocks expanded, there is a need for inexpensive more compact extenders. The fuse block extender designs of this invention provide for the use of such accessories.

Inherent in extender design considerations are ease of manufacture, the cost of tooling up for manufacturing the devices and the durability of the extenders under conditions of usage. For example, as the commercially available fuses become ever smaller, the extender elements must become correspondingly smaller. The female electrodes of accessories are correspondingly small. The heat resulting from extended use and the designed clamping pressures detrimentally accelerate the aging of the metals and leads to reduced contact pressures between the electrodes or problems with alignment during the mating of the electrodes.

Similarly, bends in the metals of the female electrodes may, under conditions of usage, become more brittle and require support because of the aging process. The extenders of this invention are designed to ameliorate these problems. Thus, shell designs for the larger fuses are more simple than designs for smaller fuses where mating problems can result in electrodes being bent during the mating process.

SUMMARY OF THE INVENTION

The fuse block extenders of this invention have a shell, a male bus electrode and a shorter circuit electrode which fit into the female electrodes of a vehicular type fuse block, one or more accessory electrodes connect to the bus electrode through fuse segments and at least one connector. The accessory electrode(s), in turn, connects to one or more accessory(ies).

DETAILED DESCRIPTION OF THE FIGURES

In the Figures, the numbers for each item remain constant but have an alphabetic identifier for any changes in form.

Figure 1:
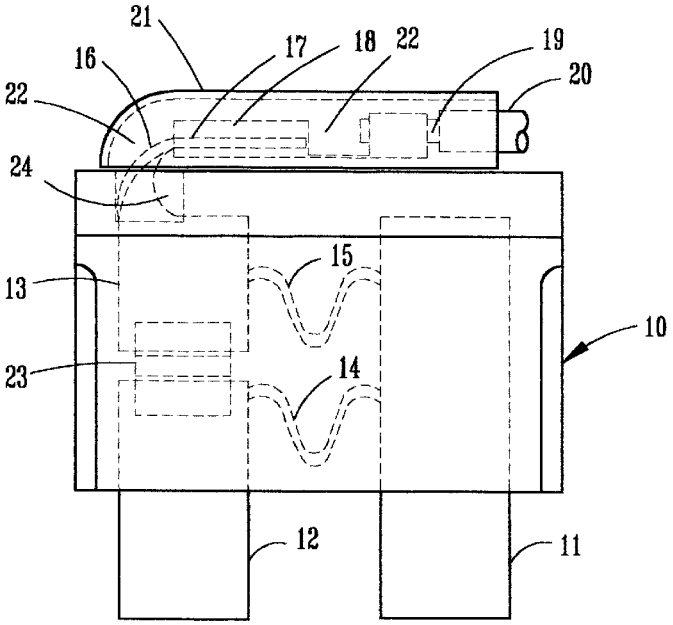
FIG. 1 is an elevation view of a fuse block extender.

FIGS. 1–4 depict a preferred model. In FIG. 1 a red tinted transparent plastic shell 10 encloses and aligns male bus electrode 11 and circuit electrode 12. Circuit electrode 12 is shorter than bus electrode 11. Electrode base 13 is separated from circuit electrode 12 and both are individually connected to bus electrode 11 by fuse segment 14 and accessory fuse segment 15, respectively. Electrode base 13 is flat and shaped to remain in one position within the shell 10. Its "panhandle" 16 makes a quarter-twist and a 90 degree bend to form an accessory electrode 17 which is inserted, i.e., electrically connected, within female electrode 18 of an accessory. Accessory circuit electrode 18 is connected to the wire 19 of cable 20. A flexible dust cover 21 is fitted over electrode 18, wire 19 and cable 20. When in place, it is fitted over accessory electrode 17 and accessory circuit electrode 18 when these items are both positioned within hollow 22. Electrode 12 and electrode base 13 are held in position within shell 10 by positioner 23.

Figure 2:
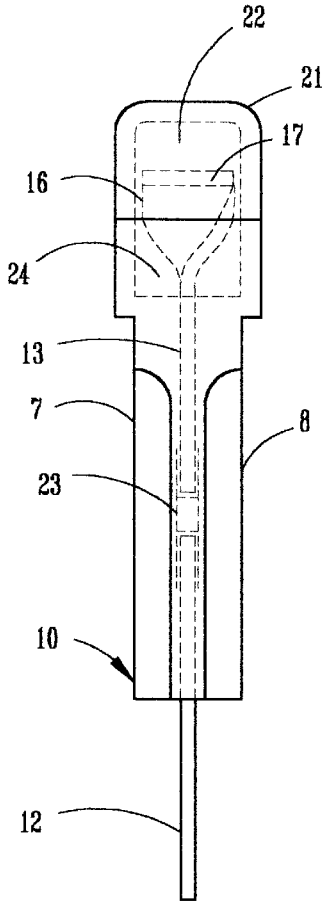
FIG. 2 is an end view of an accessory electrode and connector of the unit of FIG. 1.

FIG. 2 depicts the left end of FIG. 1 without female electrode 18 but with cover 21 in place. While shown as one straight piece, the panhandle 16 and accessory electrode 17 can be made up of more than one element and/or can be refolded to increase thickness or even to form multiple electrodes 17. The two fused shell halves 7 and 8 hold the metal elements of the extender in place by compression.

Figure 3:
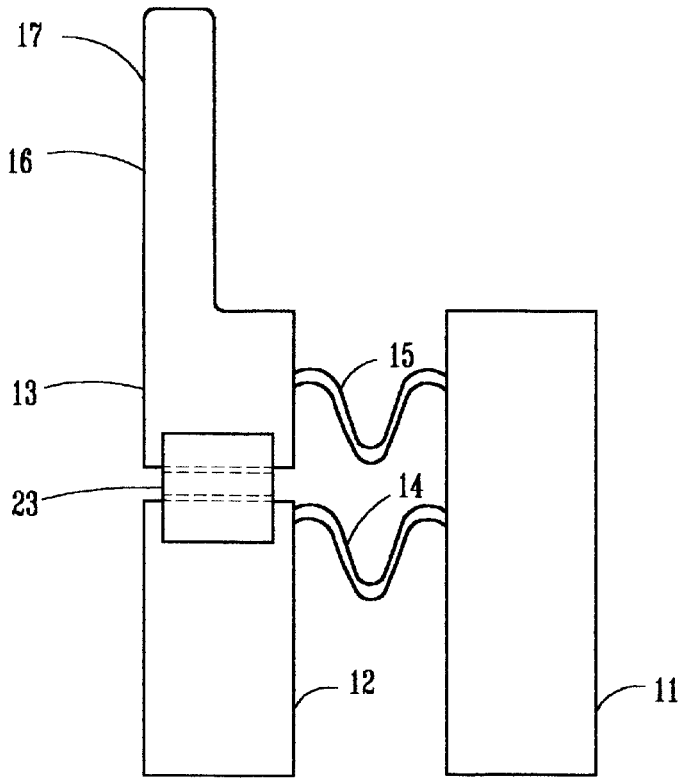
FIG. 3 depicts a layout of the metal of the fuse block extender of FIG. 1.

FIG. 3 shows unbent electrode base 13 positioned end to end with circuit electrode 12 by an electrically insulating "H" shaped positioning device 23 and positioned in parallel with and in the same plane as bus electrode 11 by the fuse segments 14 and 15.

Figure 4:
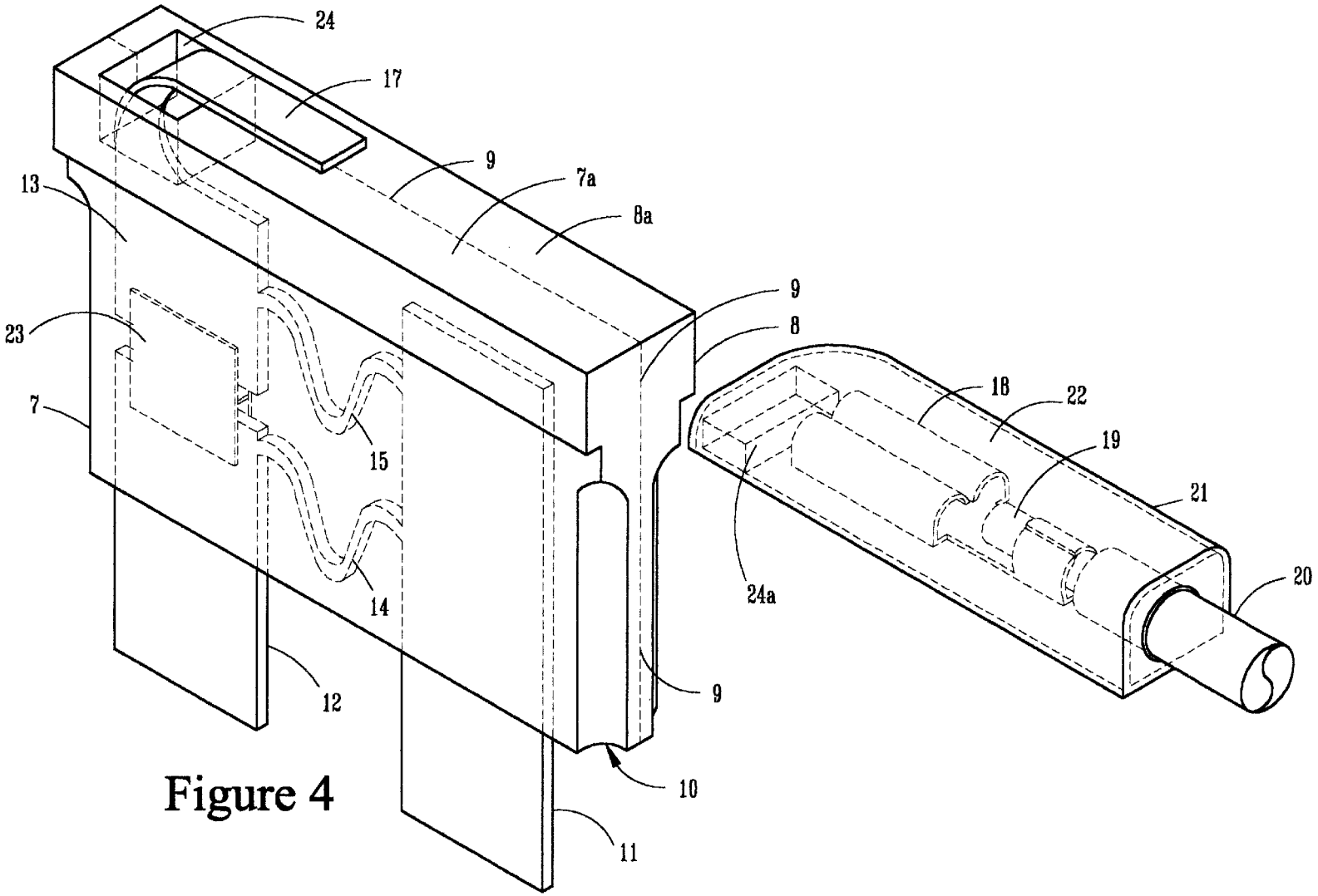
FIG. 4 is a perspective view of the fuse block extender unit and the cover of FIGS. 1–3.

The plastic shell 10, shown in FIG. 4, is made up of two mirror image "half" shells 7*a* and 8*a* connected at fusion line 9. The half shells 7 and 8 are positioned on each side of the plane of the electrodes and hold the electrically conductive elements in place. Flexible cover 21 protects the electrodes 17 and 18 from dust, oil and oxidants when accessory electrode 17 is mated into female electrode 18. Square holes 24 and 24*a* provide the passages for panhandle 16.

Figure 5:
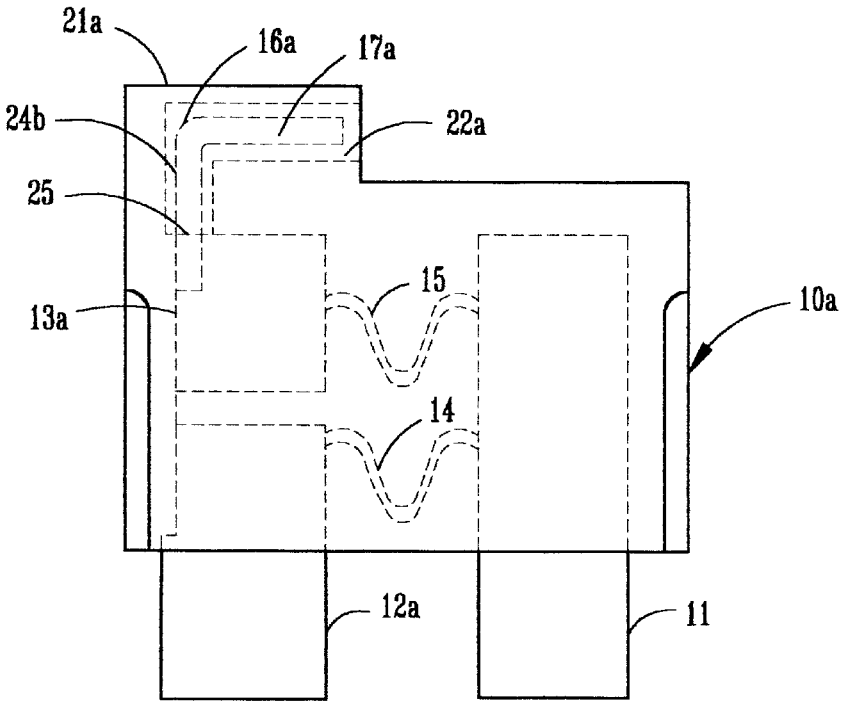
FIG. 5 depicts a second model with a male accessory electrode.

FIG. 5 depicts a model where circuit electrode 12*a* is widened at its bottom to ensure that it can help preserve circuit polarity and where connector 13*a* is square or rectangular. Male accessory electrode 17*a* is round, bent at point 16*a,* and split at point 25 to fit over a corner of electrode base 13*a* where it is welded, soldered, or brazed to electrode base 13*a*. The male accessory electrode 17*a* is housed by cover 21*a* which has a hollow 22*a* surrounding male accessory electrode 17*a*. Cover 21*a* is an integral part of shell 10*a*. Bore 24*b* encloses the base of male electrode 17*a*.

Figure 6:
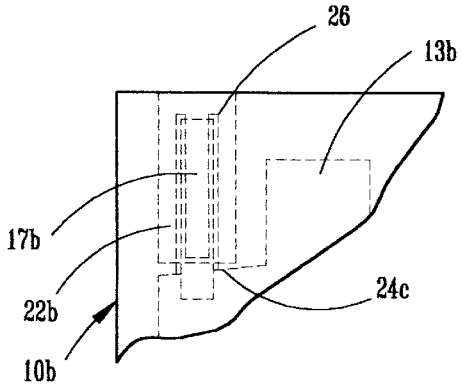
FIG. 6 depicts a portion of a connector and a female electrode positioned within the shell of the fuse block extender.

The cutaway of FIG. 6 depicts a different model of a device where electrode base 13*b* has been reduced in size and female accessory electrode 17*b* is hollow and has been split, fitted over and brazed to element 13*b* and is vertically recessed within hollow 22*c* in shell 10*b*. Accessory electrode 17*b* is externally coated with an electrical insulator coating 26.

Figure 7:
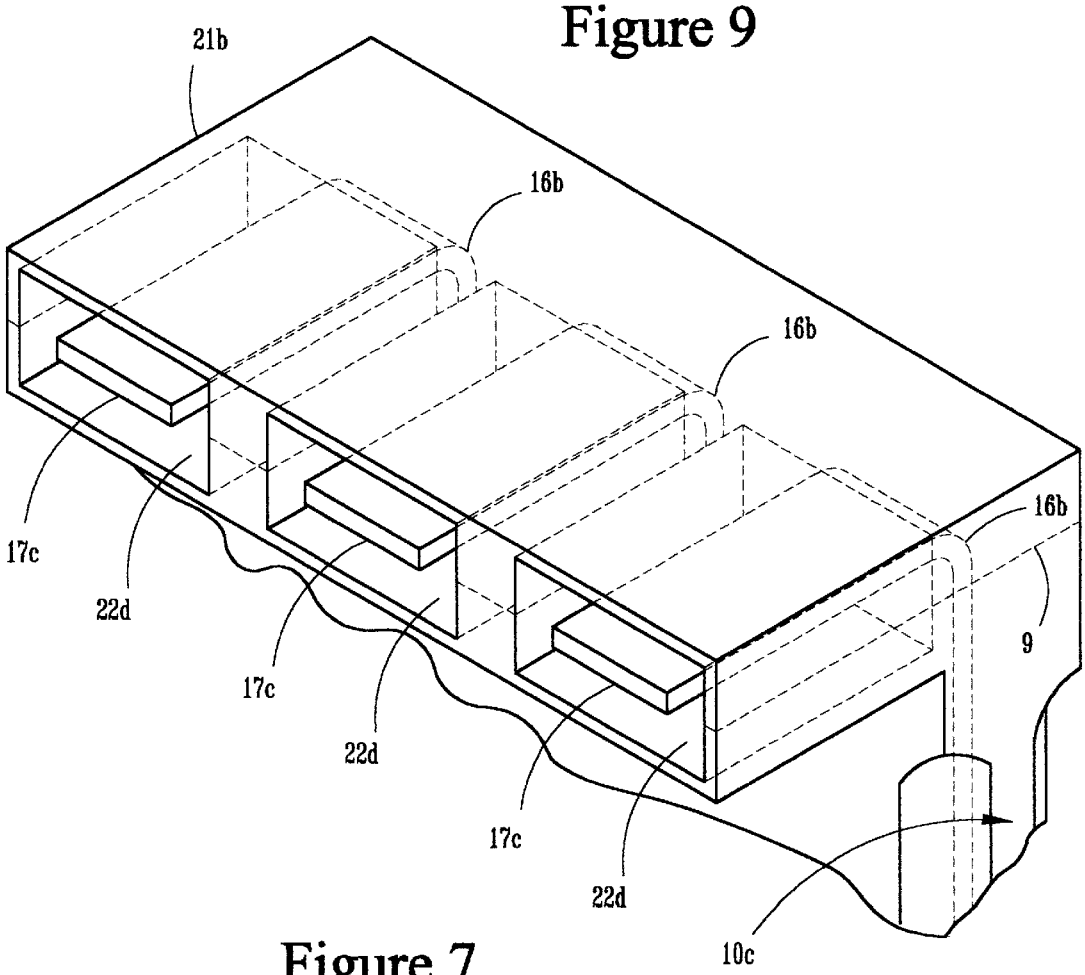
FIG. 7 depicts a portion of a fuse block extender unit where the accessory electrodes are positioned at a right angle to the "fuse" body for the purpose of having the accessory wiring enter from over the side of the fuse block.

FIG. 7 is a unit with recessed male accessory electrodes 17*c* formed from panhandles 16*b*. Accessory electrodes 17*c* are not twisted as in FIG. 1 but are bent while flat at a rounded right angle over the bottom portion of cover 21*b* which is fused to shell 10*c* along lateral fusion line 9.

Figure 8:
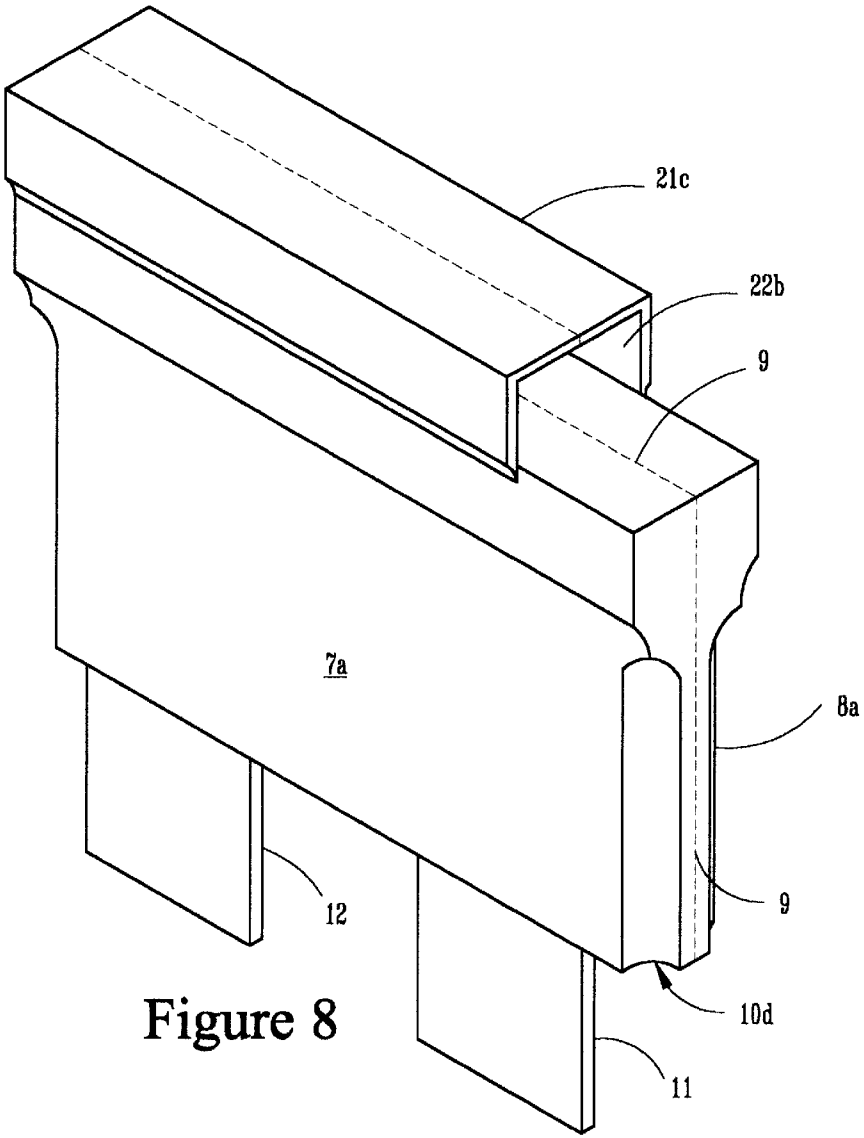
FIG. 8 depicts the most preferred configuration of the extenders.

FIG. 8 depicts the external configuration of a unit which has the same internal metal configuration as that of FIG. 3 with the positioning device 23 eliminated. The rigid cover arrangement is the most preferred because it is both wider and deeper than the cover of FIGS. 1, 2 and 4. In this model, the cover is fused to the shell 10*d* which is made up of shell halves 7*a* and 8*a*.

Figure 9:
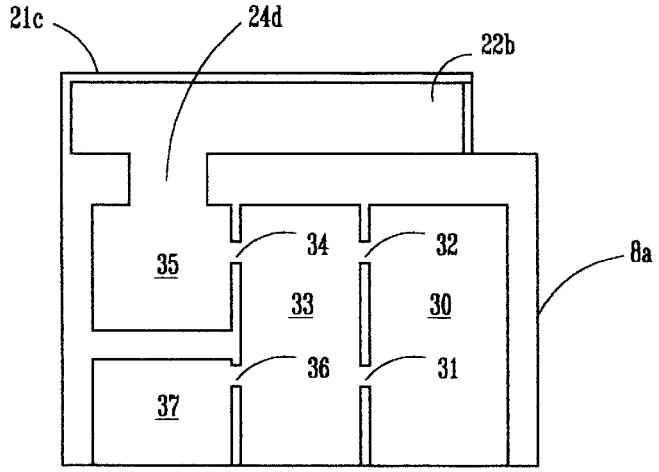
FIG. 9 depicts a "half shell" of the unit of FIG. 8.

FIG. 9 depicts, diagrammatically, the internal configuration of a half shell 8*b* of FIG. 8. The half shell 8*b* has a recess 30 with two openings 31 and 32 leading to recess 33. Recess 33 has an opening 34 into recess 35 and another opening 36 into a recess 37.

Electrodes 11 and 12 (not shown), like those of FIG. 1 and fit into recesses 30 and 37 respectively while fuse segment 14 passes through openings 31 and 36. Electrode base 13 fits into recess 35 and is connected to electrode 11 by fuse segment 15 which passes through openings 32 and 34. Preformed panhandle 16 and accessory electrode 17 pass through opening 24 to enable electrode 18 of the circuit of an accessory to slide across bottom of hollow 22 and mate with an accessory electrode 17. Shell half 8*a* is then mated with and fused to its mirror image half shell 7*a* (not shown) to form the completed assembly extender.

Figure 11:
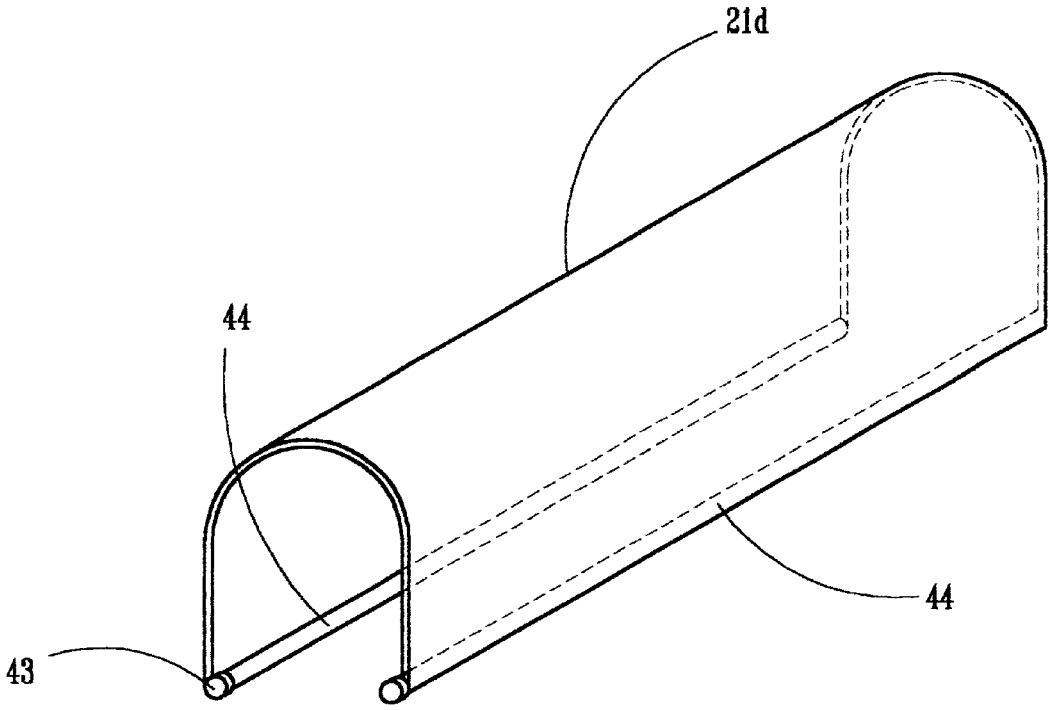
FIG. 11 shows a portion of a sliding removable cover for use with the shell of FIG. 10.
Figure 10:
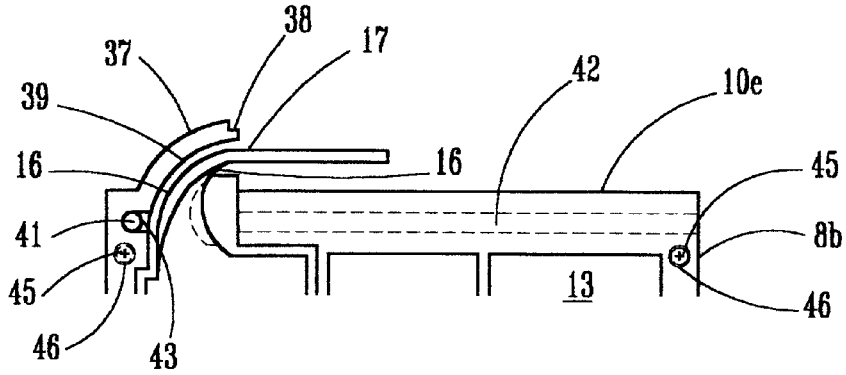
FIG. 10 depicts a portion of a half shell with a panhandle brace.

The partial shell half 8*b* of FIG. 10 includes a panhandle brace 37 which has a shoulder 38 over which the interlocking electrode cover 21*d* (See FIG. 11) seats. The face 39 of the brace 37 and its complementary/mirror image half shell (not shown) conform to the quarter twist and 90° turn of electrode 17. A small depression 41 is positioned at the end of slot 42 and receives a projection 43 on the end of rail 44, (FIG. 11). Rail 44 slides along slot 42 and seats on shoulder 38 to removably lock cover 21*d* onto shell 10*e*. Screws 45 within recesses 46 join the half shells in this model.

General Description of the Invention

The fuse extender shells are preferably made of shell halves of any non-conductive silicone, carbonate, halocarbon or other polymer usable commercially in the manufacture of vehicle fuses. The shell halves are joined by thermal or solvent fusion, adhesives, screws or other mechanism. The shells can be opaque or translucent if suitable "windows" are provided to permit visual inspection of the condition of each fuse.

The electrodes, electrode base and fuse segment materials will be any metal or metal alloy, normally used in vehicle fuse manufacture. The fuse segments can, however, be of a metal or eutectic combination of metals having a lower melting point than that of the electrodes and connectors. The fuse segments are preferably continuous but can be attached to the electrodes and connector. The covers can be of the same or different materials where attached to the shells but are preferably of a flexible material, e.g., a silicone polyurethane, or natural rubber preferably similar to those used with battery cable covers where the shell is not adapted for mating with an accessory circuit electrode dust cover. The fixed covers are preferred but not always required to shield the accessory electrodes from corrosive contaminants and dust. Accessory female electrodes like those of FIG. 6 can be externally coated with an electrically insulating material and can even protrude slightly from the shell. In some circumstances, there may be no need to insulate the accessory electrodes, e.g., when the accessory circuit electrodes and vehicle fuse accessory are positioned where they can be handled only with electrically insulated tools.

The size and thickness of the male electrodes, the accessory electrodes, fuses and/or connectors will be engineered to carry the power, i.e., amperage and voltage, required to operate the accessory for which the fuse is designed to protect. The use of multi-fused units can provide a) redundancy, for example, where a single additional fuse circuit is needed for parallel wiring or b) for multiple circuits. However, care must be taken to ensure that the total amperage conducted by the accessory electrode(s) will not overload the heat radiation or amperage capacity of the fuse/fuse block combination. This is particularly true with the small "Minifuses" and mini fuse blocks.

What is claimed is:

1. A fuse block extender comprising a bus electrode and a circuit electrode positioned substantially side by side and joined by a first fuse segment; at least one electrode base, positioned by a separate positioner member proximate to and in the same plane with each of the circuit electrode and the bus electrode, which is connected to the bus electrode by an additional fuse segment per electrode base, at least one accessory electrode extending from the at least one electrode base substantially enclosed within at least one of a cover and a shell, the at least one electrode base, the fuse segments and substantial portions of the bus electrode and circuit electrode are enclosed within the shell; the bus electrode and circuit electrode portions external to the shell being in the form of electrodes complementary to the electrodes of a predetermined fuse block of appropriate amperage.

2. A fuse block extender comprising a shell, formed from substantially half shells, enclosing a portion of each of a bus electrode and a circuit electrode which are positioned substantially side by side in a plane within recesses in at least one of the substantially half shells and are joined by a first fuse segment, at least one electrode base also positioned within recesses substantially within the plane; at least one fuse segment per the at least one electrode base joining the bus electrode to each of the at least one electrode base; and an accessory electrode connected to each of the at least one electrode base; and at least one of portions of the shell, an insulating coating, or a cover to partially enclose each of the at least one accessory electrode to protect the user of the extender; each of the fuse segments being electrically isolated within the recesses during fuse segment failure.

3. The fuse block extender of claim 1 or 2 wherein the at least one electrode base is connected to a substantially round accessory electrode.

4. The fuse block extender of claim 3 wherein the substantially round accesory electrode is a male electrode.

5. The fuse block extender of claim 3 wherein the substantially round accesory electrode is a female electrode.

6. The fuse block extender of claim 3 wherein the accesory electrode is bent sustantially at a right angle.

7. The fuse block extender of claim 1 or 2 wherein the outer surface of each female electrode is electrically insulated.

8. The fuse block extender of claim 1 wherein the positioner member spaces apart and at least partially positions the circuit electrode and the at least one electrode base.

9. A fuse block extender of claim 2 wherein the fuse segments, at least one electrode base and at least one accessory electrode and portions of the bus electrode and the circuit electrode are positioned within the shell by the compression exerted by the fused shell halves, the accessory electrode being connected to at least one accessory circuit electrode.

10. The fuse block extender of claim 1 wherein shell further includes brace means for bracing at least one accessory electrode panhandle.

11. The fuse block extender of claim 10 wherein the cover has a substantially "U" shape and has a rail proximate to the edge of the inner surface of each of the legs of the "U".

12. The fuse block extender of claim 1 or 2 wherein the cover is mechanically attachable.

13. The fuse block extender of claim 1 or 2 wherein at least a portion of the cover is flexible.

14. A fuse block extender comprising a) a shell partially enclosing a bus electrode and a circuit electrode and fully enclosing a fuse segment connecting the bus electrode and the circuit electrode the portions of the-bus electrode and the circuit electrode external to the shell having a form complementary to the electrodes of a fuse block of appropriate amperage and polarity;

at least one electrode base connected to the bus electrode by an additional fuse segment per electrode base is positioned by a separate positioner member and b) at least one accessory electrode enclosed within a cover means, the cover means having an opening for insertion of at least one electrode of an accessory circuit and an opening for positioning the cover means on the shell for the purpose of protecting a user of the fuse block extender.

15. A fuse block extender comprising a bus electrode and a circuit electrode positioned substantially side by side and joined by a first fuse segment; at least one electrode base, positioned proximate to and in the same plane with each of the circuit electrode and the bus electrode, which is connected to the bus electrode by an additional fuse segment per electrode base, at least one female accessory electrode, coated on its outer surface with an electrical insulator, extending from each of the at least one electrode base and substantially enclosed within at least the shell, the fuse segment and substantial portions of the bus electrode and the circuit electrode are enclosed within the shell; the bus electrode and circuit electrode portions external to the shell being in the form of electrodes complementary to the electrodes of a predetermined fuse block of appropriate amperage.

16. A fuse block extender comprising a bus electrode and a circuit electrode positioned substantially side by side and joined by a first fuse segment; at least one electrode base, having at least a 90° bend with a quarter twist positioned proximate to and in the same plane with each of the circuit electrode and the bus electrode, the electrode base is connected to the bus electrode by an additional fuse segment per the electrode base, at least one accessory electrode extending from each of the at least one electrode base and substantially enclosed within at least one of a cover and a shell, the at least one electrode base, the fuse segments and substantial portions of the bus electrode and circuit electrode are enclosed within the shell; the bus electrode and circuit electrode portions external to the shell being in the form of electrodes complementary to the electrodes of a predetermined fuse block of appropriate amperage.

* * * * *